United States Patent [19]

Shaw et al.

[11] Patent Number: 4,613,039

[45] Date of Patent: Sep. 23, 1986

[54] DROP BOTTOM GARMENT BAG

[75] Inventors: Anthony Shaw, Chappaqua, N.Y.; Jesse Zuckerbrod, Hillsdale, N.J.

[73] Assignee: D. Klein & Son, Inc., Lodi, N.J.

[21] Appl. No.: 710,584

[22] Filed: Mar. 11, 1985

[51] Int. Cl.[4] ..... A45C 7/00; B65D 85/18

[52] U.S. Cl. ..... 206/287.1; 383/2; 190/103

[58] Field of Search ..... 206/287, 287.1; 190/103; 383/2

[56] References Cited

U.S. PATENT DOCUMENTS

| | | | |
|---|---|---|---|
| 1,651,706 | 12/1927 | Holbrooks | 206/287 |
| 2,078,624 | 4/1937 | Wolff | 383/2 |
| 2,596,412 | 5/1952 | Kish, Jr. et al. | 206/287.1 X |
| 2,606,636 | 8/1952 | Braverman | 206/287.1 |
| 2,689,631 | 9/1954 | Marks | 206/287.1 X |
| 2,774,450 | 12/1956 | Smallberg | 206/287.1 X |
| 3,244,261 | 4/1966 | Herz | 206/287 X |
| 4,236,615 | 12/1980 | Ginat | 190/103 X |
| 4,489,829 | 12/1984 | Myers et al. | 206/287 |

FOREIGN PATENT DOCUMENTS

| | | | |
|---|---|---|---|
| 1039181 | 5/1953 | France | 206/287 |
| 187394 | 1/1937 | Switzerland | 206/287 |

*Primary Examiner*—William Price
*Assistant Examiner*—Sue A. Weaver
*Attorney, Agent, or Firm*—McAulay, Fields, Fisher, Goldstein & Nissen

[57] ABSTRACT

A garment bag can selectively neatly retain either men's or women's clothing. The garment bag includes a garment receiving compartment defined by front and rear panels which are interconnected by respective side panels. A closable opening in the front panel permits access to the compartment. The compartment also includes a selectively closable bottom opening. Connected to the edges defining the bottom opening is a pocket which is movable between a first position in which it received within the compartment and second position in which it extends outward from the bottom opening to increase the effective length of the compartment.

6 Claims, 7 Drawing Figures

DROP BOTTOM GARMENT BAG

BACKGROUND OF THE INVENTION

The present invention relates to a garment bag and more particularly to a garment bag which can be used for carrying men's suits or selectively lengthened to carry women's dresses or gowns.

So-called suit or dress garment bags that can be folded for carrying garments while traveling, or unfolded and hung in a closet are known in the art. Although these foldable garment bags provide a convenient way to transport and protect clothing, they are generally sized to hold either men's clothing or women's clothing—not both. Specifically, garment bags designed to hold men's clothing are not long enough to retain women's clothing without creasing the women's longer length clothing. Garment bags designed to hold women's clothing, although capable of holding men's clothing, are bigger than necessary when used for men's clothing and hence waste space and are less easy to handly. Additionally, the smaller length men's clothing can move and therefore crease.

It is desirable to have a single garment bag which can neatly retain either men's or women's clothing.

Accordingly, it is an object of this invention to provide a garment bag which can be used for either men's clothing or selectively lengthened for women's clothing.

It is another object of the present invention to provide such a garment bag which is attractive in appearance and easy to use.

Yet a further object of the invention is to provide such a garment bag which is no more expensive than present garment bags.

BRIEF DESCRIPTION

In one embodiment of the invention, a garment bag is provided which can be used for carrying men's clothing or selectively lengthened to carry women's clothing. The garment bag is provided with front and rear panels interconnected by side panels to define a garment receiving compartment. The front panel has a closable opening therein to permit access to the garment receiving compartment. A bottom opening is formed in the garment receiving compartment and is provided with a closing means for selectively closing the bottom opening. The garment bag includes a pocket having edges connected to the edges which define the bottom opening. The pocket is movable between a first position, in which it is received within the compartment, and a second position, in which it extends outwardly from the bottom opening to increase the effective length of the garment receiving compartment.

It is contemplated that the garment bag, as briefly described above, will be usable with the pocket in its first position for men's garments or with the pocket in its second position for women's dresses and gowns. In this manner the garment bag will avoid the problems of prior art bags.

DESCRIPTION OF THE PREFERRED EMBODIMENTS

Figure 1:
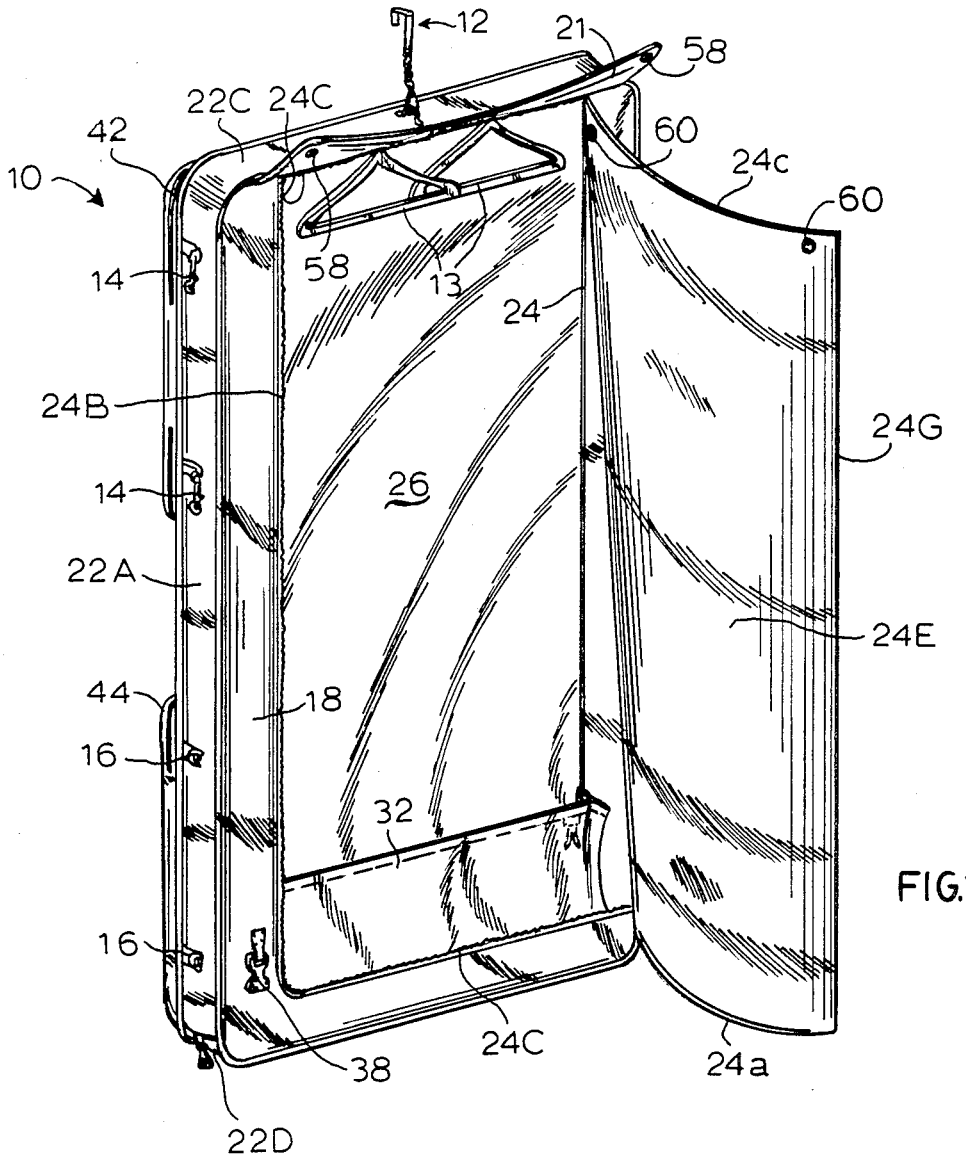
FIG. 1 is a perspective view of the garment bag of the present invention showing the garment receiving compartment open and the extensible pocket received within the garment bag.

As shown in the FIGS., the foldable garment bag of the present invention is designated generally by the reference numeral 10 and includes a front panel 18 and a rear panel 20 interconnected by side panels 22A, 22B, a top panel 22C and a bottom panel 22D to define a garment receiving compartment 26. A generally C-shaped opening 24 closable by a flap 24E is provided in front panel 18 to permit access to the garment receiving compartment 26. Clothing can be retained within compartment 26 during travel and/or when the bag 10 is hung in a closet. A zipper extends along the bottom edge 24C and side edge 24B of the opening 24 and mates with a corresponding section on the flap 24E to permit closing or opening of the flap. When the bag is in the open position, clothing can be easily placed into or taken out of compartment 26. When opening 24 is closed, the clothing in compartment 26 is protected. To further protect the clothing, a small flap 21 is provided on front panel 18 which can overlie and attach adjacent the top edge of flap 24E by mating snaps 58, 60.

Figure 2:
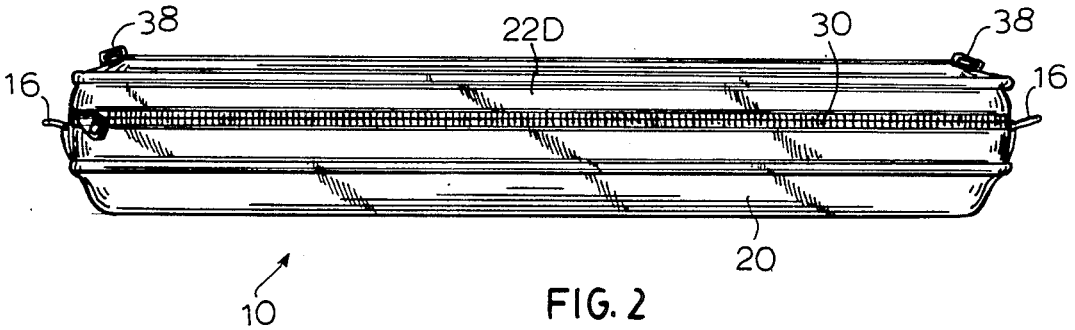
FIG. 2 is a bottom view of the present garment bag showing the bottom opening in closed position.
Figure 5:
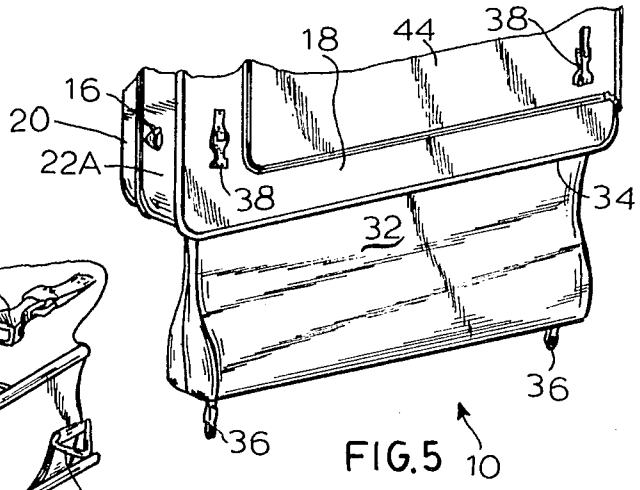
FIG. 5 is a partial perspective view showing the pocket in its extended position, as viewed from the front.

As best seen in FIG. 2, garment bag 10 is provided with a bottom opening 28 formed in bottom panel 22D. Closing means 30 which permits selective closing of bottom opening 28 are provided. In a preferred embodiment, closing means 30 is a zipper which is co-extensive in length with the length of garment bag 10.

Garment bag 10 is provided with a pocket 32. Pocket 32, as best seen in FIGS. 3 and 4 is connected along its respective edges 34 to the edges defining bottom opening 28.

Figure 4:
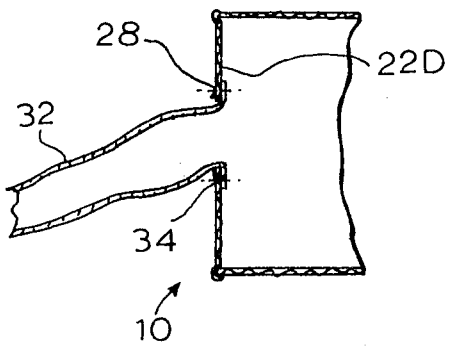
FIG. 4 is a sectional view taken substantially along line 4—4 of FIG. 3.
Figure 3:
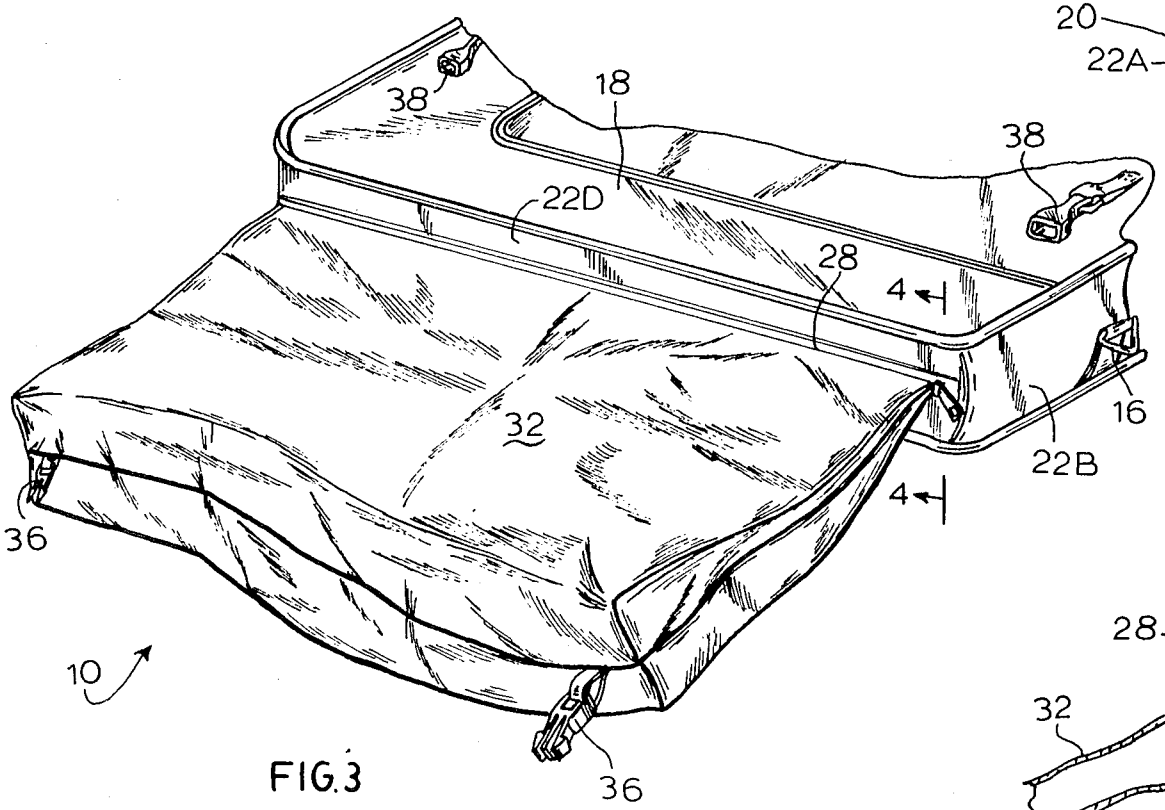
FIG. 3 is a partial perspective view of the garment bag showing the pocket in its extended position, and as viewed from the bottom.

Pocket 32 is movable between a first position, shown in FIG. 1 in which it is received within compartment 26, to a second position shown in FIGS. 3 and 4, in which it extends outwardly from bottom opening 28 to increase the effective length of garment receiving compartment 26. It is contemplated that when men's clothing is retained within compartment 26, pocket 32 will be maintained in its first position and that when women's clothing is retained in compartment 26, pocket 32 will be maintained in its second position.

Figure 6:
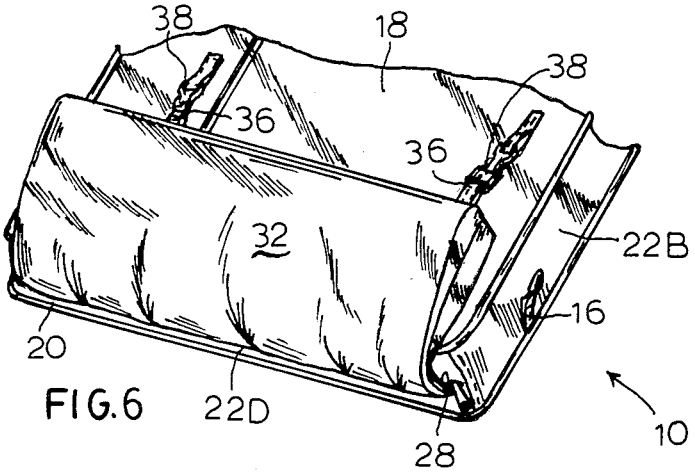
FIG. 6 is a partial detail view showing the pocket in extended position and folded upwardly and attached to the front panel.

Two spaced apart male fittings 36 are provided at the bottom of the pocket. The male fittings are capable of mating with two spaced apart female fittings 38. In a preferred embodiment the male fittings are attached to the bottom portion of pocket 32 and the female fittings are attached to the lower part of front panel 18. The male and female fittings, as best shown in FIG. 6, permit pocket 32, when in its second position to be folded up and connected to front panel 18.

Figure 7:
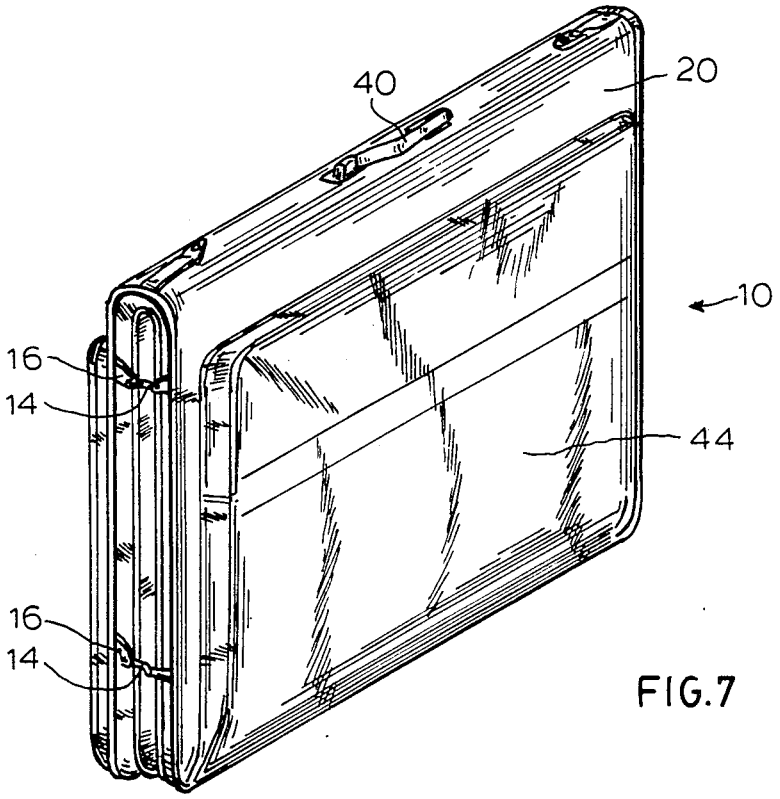
FIG. 7 is a perspective view showing the garment bag in its fully closed and folded position.

As is conventional in the art, bag 10, as best seen in FIG. 7, is provided with a carrying handle 40 to permit the bag to be easily transported in its fully folded state. Bag 10 may be further provided with a plurality of extra compartments, such as compartments 42 and 44, each of which may have its own zipper closure, to permit items of apparel to be segregated from one another while traveling. Additionally, garment bag 10 includes a hook 12 to permit a person to hang the bag from a closet rod; hangers 13 are removably received within garment receiving compartment 26 on which clothing can be hung; and hooks 14 and eyes 16 usable to maintain the bag in its fully folded position. The bag 10 may be constructed of any appropriate material. Preferable the bag is light-weight, durable and water resistant.

Garment bag 10, with pocket 32 in its first position is in appropriate length to neatly fold men's suits. Garment bag 10, with pocket 32 in its second position is in appropriate length two hold women's dresses. It is easy to move pocket 32 from one position to another; one merely opens the bottom opening and unfolds the pocket from its first to its second position or, in the alternative, folds the pocket back into compartment 26 and closes the opening to move the pocket from its second to its first position.

It will be understood that each of the elements described above, or two or more together, may also find useful application in other types of constructions aside from the type described above.

While the invention has been illustrated and described as embodies in a garment bag which can selectively be used for men's or women's clothing, it is not intended to be limited to the details shown, since various modifications and structural changes may be made without departing in any may from the spirit of the invention.

Without further analysis, the foregoing will so fully reveal the gist of the present invention that others can be applying current knowledge readily adapt if for various applications without ommiting features that, from the standpoint of prior art, fairly constitute essential characteristics of the generic or specific aspects of this invention and, therefore, such adaptions should and are intended to be comprehended within the meaning and range of equivalence of the following claims.

What is claimed:

1. A garment bag comprising:

a garment receiving compartment defined by front and rear panels interconnected by respective side, top and bottom panels;

a closable opening in said front panel to permit access to said compartment;

a slit in said bottom panel forming a bottom opening in said compartment;

closing means for selectively closing said bottom opening;

a pocket having edges connected to the edges defining said bottom opening slit and movable between a first position in which said pocket is received within said compartment, and a second position in which said pocket extends outwardly from said bottom opening to increase the effective length of said garment receiving compartment;

attaching means on the bottom of said pocket and on the outer surface of said front panel for connecting said pocket to said front panel in a folded upward condition when said pocket is in said second position;

said garment bag being adapted to be folded along a fold line with one portion of said front panel superposed on the other portion to sandwich said extended pocket therebetween to protect said pocket from damage.

2. The garment bag of claim 1, wherein said attaching means comprises two spaced apart female fittings on one of said pocket or said panel and two mating male fittings on the other of said pockets or panel.

3. The garment bag of claim 1, wherein the length of said closable opening is approximately equal to the length of said garment bag.

4. A garment bag as in claim 1, and support means connected to the top of said bag for supporting said bag from a support.

5. A garment bag as in claim 1, and fastening means on said side panels for fastening said bag in a folded-over position.

6. A garment bag as in claim 1, and at least one closable pocket on the outer surface of said rear panel.

* * * * *